343-700 MS AU 251 FX
8/7/84 OR 4,464,663

United States Patent [19]

Lalezari et al.

[11] Patent Number: 4,464,663

[45] Date of Patent: Aug. 7, 1984

[54] DUAL POLARIZED, HIGH EFFICIENCY MICROSTRIP ANTENNA

[75] Inventors: Farzin Lalezari; Robert E. Munson, both of Boulder, Colo.

[73] Assignee: Ball Corporation, Muncie, Ind.

[21] Appl. No.: 322,930

[22] Filed: Nov. 19, 1981

[51] Int. Cl.[3] ..... H01Q 1/38; H01Q 9/38

[52] U.S. Cl. ..... 343/700 MS; 343/846

[58] Field of Search ..... 343/700 MS, 829, 830, 343/846, 770, 771

[56] References Cited

U.S. PATENT DOCUMENTS

| | | | |
|---|---|---|---|
| 3,921,177 | 11/1975 | Munson | 343/846 |
| 3,971,032 | 7/1976 | Munson et al. | 343/700 MS |
| 4,074,270 | 2/1978 | Kaloi | 343/700 MS |
| 4,125,837 | 11/1978 | Kaloi | 343/700 MS |
| 4,131,892 | 12/1978 | Munson et al. | 343/700 MS |
| 4,131,893 | 12/1978 | Munson et al. | 343/700 MS |
| 4,233,607 | 11/1980 | Sanford et al. | 343/700 MS |
| 4,356,492 | 10/1982 | Kaloi | 343/700 MS |
| 4,379,296 | 4/1983 | Farrar et al. | 343/700 MS |

FOREIGN PATENT DOCUMENTS

| | | | |
|---|---|---|---|
| 2711313 | 11/1977 | Fed. Rep. of Germany | 343/700 MS |

*Primary Examiner*—Eli Lieberman
*Assistant Examiner*—Michael C. Wimer
*Attorney, Agent, or Firm*—Gilbert E. Alberding

[57] ABSTRACT

A pair of spaced apart resonant microstrip radiators is fed from two differently polarized input/output ports by respective different feedlines to achieve different respective polarizations while at the same time minimizing undesirable r.f. coupling between the input/output ports. The preferred design embodiment minimizes feedline length while simultaneously increasing the r.f. isolation between the two differently polarized input-/output ports.

22 Claims, 4 Drawing Figures

DUAL POLARIZED, HIGH EFFICIENCY MICROSTRIP ANTENNA

This invention relates generally to microstrip antennas of the type having integral microstrip feedline and resonant radiating patches in an electrically conducting layer spaced by a dielectric layer above an underlying groundplane. The thickness of the dielectric in terms of wavelength is less than one-fourth wavelength as measured in the dielectric at the operating frequency of the antenna and is typically on the order of a tenth wavelength or less.

This particular invention represents an improvement of dual polarized microstrip antennas known heretofore. It utilizes pairs of dual polarized microstrip radiators fed with separate sets of feedlines connected to provide differently polarized input/output ports having enhanced electrical isolation while at the same time minimizing feedline lengths and providing other advantages. It is in some ways related to commonly assigned issued U.S. Pat. No. 3,921,177 (now U.S. Pat. No. Re. 29,911) which discloses dual feedlines to a dual polarized single radiating patch; to U.S. Pat. No. 4,131,892 which also discloses an arrangement of orthogonally polarized radiating slots and to U.S. Pat. No. 4,131,893 which is related to the '892 patent.

Microstrip antennas of this general type are well known in the art as evidenced, in part, by the just referenced related prior patents. In one exemplary form, the resonant radiating patches are substantially square-shaped (one-half wavelength, as measured in the dielectric, on each side) and fed from one side to excite radiating apertures formed beneath the transverse edges of the patch and the underlying groundplane. A feedline connected to an adjacent orthogonal side of the square can then be utilized to excite another pair of radiating apertures formed between the remaining pair of patch edges and the underlying groundplane. As will be appreciated, the r.f. fields radiated to/from this antenna structure will have one polarization for one pair of radiating apertures and another (orthogonal in the exemplary embodiment) polarization for the other pair of radiating apertures. Although there is a degree of isolation between such prior art dual polarized microstrip radiators, there is also unavoidable direct coupling between the input/output ports connected to these different pairs of differently polarized radiating apertures. Often such feed through is on the order of −20 decibels which is undesirably high for many applications.

Now, however, it has been discovered that if such dual polarized radiating patches are utilized in pairs, with one of the polarized feeds being provided back-to-back between the spaced apart pair of patches with a feedline system that incorporates a 180 electrical degree phase difference, enhanced isolation can be obtained between input/output ports for the differently polarized r.f. signals while at the same time minimizing the necessary feedline length and enhancing overall antenna efficiency. This design also permits the realization of a dual polarized microstrip antenna from a single array aperture as will be appreciated. Preferably, low permitivity dielectric constant substrates are utilized so as to further increase the directivity of the element and eliminate undesirable grating lobes.

In the preferred exemplary embodiment, first and second radiating patches are each of substantially square dimension so as to resonant at substantially the same operating frequency along either of their orthogonal axes. Thus, when fed in one direction, a pair of radiating apertures formed by the edges of a given patch and the underlying groundplane will radiate with one polarization and if fed in the other orthogonal direction, the remaining pair of radiating apertures formed by the remaining edges of the underlying groundplane will radiate with a second orthogonal polarization. A first feedline system having substantially equal length respective portions leading from a first input/output port to respective corresponding sides of the patches is then used for exciting four horizontal radiating apertures (which produce vertically polarized radiation). A second feedline system including unequal lengths of feedline connecting respective back-to-back edges of the patches is utilized for exciting the four vertical radiating apertures (which produce horizontally polarized radiation). The unequal feedline lengths in this second system of feedlines are preferably different by substantially one-half wavelength (180 electrical degrees). Accordingly, undesirable r.f. energy coupled directly from the first input/output port into the second feedline system will substantially cancel at the second input/output port thus greatly enhancing the isolation in feed through from the first port to the second. Similarly, undesirable r.f. feed through from the second input/output port to the first will also be 180° out of phase when the respective portions are summed at a node connected to the first port thus substantially increasing the isolation in the opposite direction as well. At the same time, the second feedline system is of minimum length because it does not have to be rotated completely around the patches but, rather, is disposed at least partly in the space between the two radiating patches and connected to them back-to-back. As will be appreciated, minimum feedline lengths are important to the achievement of higher efficiency microstrip antenna structures.

The centers of the microstrip radiators are preferably spaced by approximately 0.95 wavelength (as measured in air) to allow for maximum spacing between elements (without creating undesirable pattern lobes) and thus to maximize room for the required two portions of feedline lengths at least partly disposed between the spaced apart pair of microstrip radiators. The pairs of such elements (including the back-to-back feeding in one polarization with included 180° phase shift to minimize total line length and increase isolation) is also well suited to replication in an antenna array structure to achieve an improved array aperture having dual polarization capability together with high efficiency and high isolation between overall input/output ports for the different polarizations.

These and other objects and advantages of the invention will be more completely appreciated and understood by considering the following detailed description of the presently preferred exemplary embodiment taken in conjunction with the accompanying drawings, of which:

Figure 1:
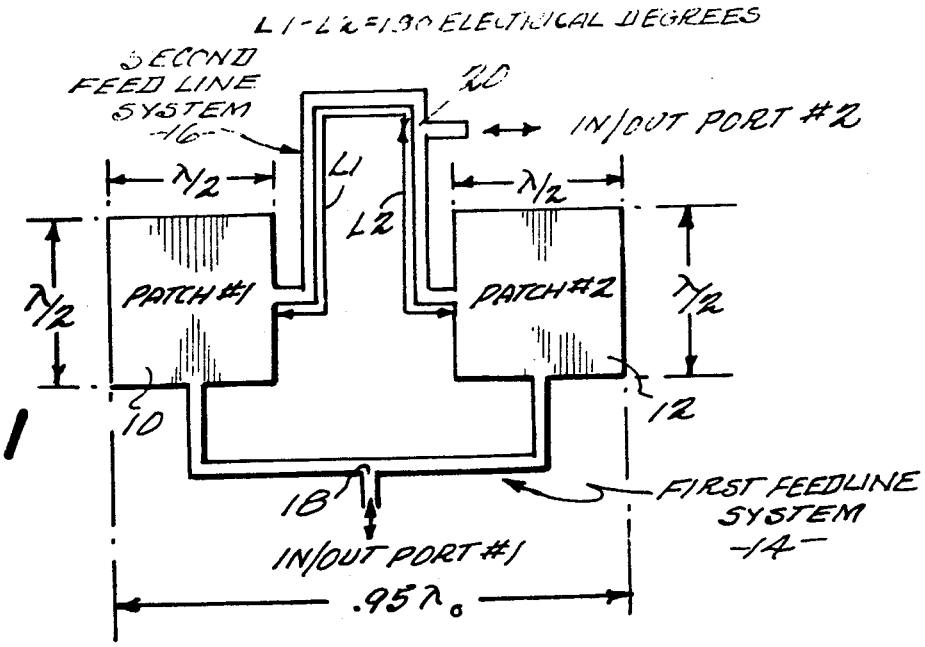
FIG. 1 is a diagrammatic plan view of the presently preferred exemplary embodiment.

Shown in FIG. 1 is a plan view of the microstrip radiator patches 10, 12 and associated feedlines 14, 16 connected to separate differently polarized input/output ports 18, 20 for an exemplary embodiment of the invention. It should be appreciated that the drawing in FIG. 1 is not drawn to scale and that the microstrip feedline depicted in FIG. 1 is simplified by not showing any desired or necessary impedance transformations-/impedance matching transitions or the like which might be used for a specifically designed installation. However, those ordinarily skilled in this art are well aware of conventional microstrip transmission line design techniques for achieving desired impedance transformations/matching, etcetera. It should also be understood that the microstrip radiators and feedlines shown in FIG. 1 are normally integrally formed using conventional printed circuit construction techniques from a layer of conductive material spaced by a dielectric substrate above an underlying continuous groundplane of conductive material. The spacing between these conductive layers is less than one-fourth wavelength and typically on the order of a tenth wavelength or less (as measured in the dielectric). Dielectric substrates having low dielectric constants are preferred so as to increase the directivity of the resulting antenna element and to help eliminate grating lobes.

Figure 2:
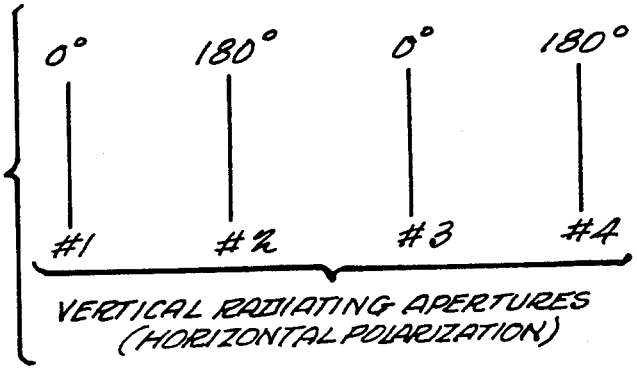
FIG. 2 is an explanatory depiction of the vertical radiating apertures present in the embodiment of FIG. 1.
Figure 3:
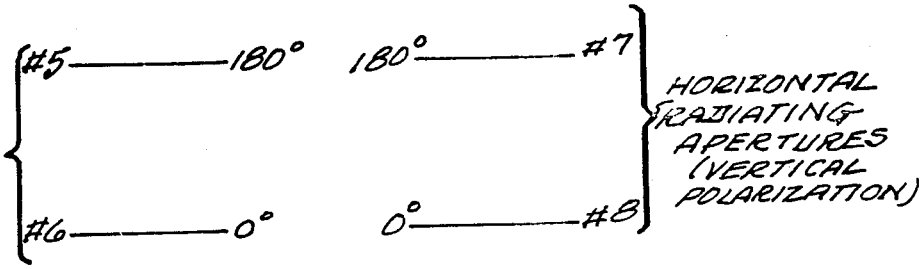
FIG. 3 is an explanatory depiction of the horizontal radiating apertures present in the embodiment of FIG. 1.

As should be appreciated by those in the art, one operating explanation for microstrip antenna structures is that the edges of the resonant microstrip patches define radiating apertures with the underlying groundplane. Thus, as shown in FIGS. 2 and 3 respectively, the two spaced apart resonant patches define four vertical radiating apertures and four horizontal radiating apertures. In the preferred embodiment, the resonant patches are substantially square and substantially one-half wavelength (as measured in the dielectric) in dimension along each side. R.f. signals at the proper resonant frequency then fed to the bottom side of patch number 1, for example, will excite horizontal radiating apertures 5 and 6 which will have respective electrical phases of 0° and 180° as shown in FIG. 3 because of the half wavelength spacing therebetween. However, also because of this half wavelength spacing, the far fields will add from these two apertures will add as is known in the art. The resulting radiation will have a polarization transverse to the radiating apertures which, in the exemplary drawings, has been denoted as vertical polarization.

As shown in FIG. 1, the horizontal radiating apertures are fed with a first corporate structured feedline system 14 which connects input/output port 18 to the lower edges (preferably the midpoint thereof) of each of patches 10 and 12. In this manner, all four horizontal radiating apertures 5-8 shown in FIG. 3 are properly excited with appropriate phases so as to provide an additive far field having a first polarization (e.g. vertical as shown in the Figures).

Similarly, if the vertical radiating apertures 1-4 depicted in FIG. 2 are fed and phased so as to provide additive far field components, horizontally polarized antenna operation can be obtained. A traditional prior art technique for achieving this operation would be to feed either both the left-hand edges or both the right-hand edges of these patches with r.f. signals having common phasing (e.g. 0°). If that is done however, there will be an undesirably large (approximately −20 db) coupling between the input/output ports 18, 20 for the different polarizations of r.f. signals.

However, with this invention, it has been discovered that a pair of patches such as shown in FIG. 1 can be fed back-to-back with a second microstrip feedline system having different unequal length respective portions L1 and L2 (preferably this difference is substantially 180 electrical degrees) and still excite all four of the vertical radiated apertures with appropriate phases of r.f. energy as shown in FIG. 2 so as to achieve additive far fields. However, because of the 180° phase difference in line lengths L1 and L2 as shown in FIG. 1, any vertically polarized r.f. energy directly coupled into these portions of the second feedline system from the first input-/output port will substantially cancel at the juncture 20 of L1 and L2 leading to input/output port number 2. Similarly, horizontally polarized r.f. energy undesirably coupled from input/output port number 2 to the respective branches of the first feedline system will also be 180° out of phase so that they substantially cancel at the feedline juncture 18 in the first feedline system which leads to the input/output port number 1. Thus, extremely high isolation has been obtained in both directions between the input/output ports for the different polarizations.

At the same time, by feeding this pair of patches back-to-back for horizontal polarization, the necessary feedline length of the second feedline system has been minimized over that which would have typically been required if both patches were fed from their respective left-hand sides or right-hand sides. Since microstrip feedlines constitute a loss element in microstrip antennas, the minimization of feedline length also increases antenna efficiency. Such minimization of microstrip feedline also permits more compact arrays (comprising plural such pairs of patches) to be formed as shown in FIG. 4.

Figure 4:
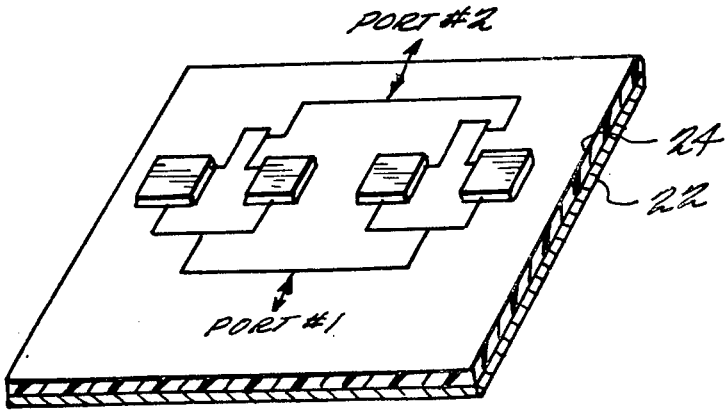
FIG. 4 is a perspective view of an antenna array comprising plural dual polarized microstrip antennas as shown in FIGS. 1-3.

The underlying groundplane 22 is shown explicitly in FIG. 4 as is the dielectric spacing layer 24. Also shown in FIG. 4 are plural pairs of dual polarized microstrip antenna structures of the type as shown in FIG. 1 connected with corporate structured microstrip feedline to different input/output ports for the different respective polarizations of r.f. signals. As should be appreciated, large array apertures forming many such pairs of dual polarized microstrip antenna structures can be realized and such large array apertures will not only provide desired dual polarized operation within a single array aperture, but also will provide greatly enhanced isolation between the differently polarized input/output ports while at the same time providing enhanced efficiency and permitting increased numbers of individual antenna elements within a given size of array aperture.

If individual elements are spaced apart more than about one wavelength (as measured in air, center-to-center) undesirable lobes can be expected in the radiation pattern. Accordingly, as shown in FIG. 1 each pair of patches is preferably spaced center-to-center only approximately 0.95 wavelength (as measured in air) to maximize the available room for the required two portions of feedline L1 and L2 disposed therebetween so as to feed these patches back-to-back with unequally phased r.f. signals (preferably out of phase by substantially 180 electrical degrees).

Accordingly, in this system pairs of microstrip radiators are utilized and fed by different feedline system so as to obtain dual polarized operation. While one feedline system may be of a conventional design, the other feedline system is designed so as to feed each pair back-to-back with r.f. signals having substantially 180° phase difference therebetween. The result not only minimizes the length of necessary microstrip feedline structure (therefore increasing the overall efficiency of the antenna), it also simultaneously provides very high isolation between the differently polarized input/output ports (in both directions). It also provides both polarizations of antenna operations from a single array aperture. In brief, by this particular arrangement of pairs of patches and special feedline systems, cross polarized energy that is undesirably directly coupled into each feedline system is substantially cancelled at feedline junction points leading to respective input/output ports because of the relative 180° phase difference between different but substantially equal components of such undesired cross polarized energy.

As should be appreciated by those in the art, the antenna structures described herein can be used solely for receiving or solely for transmitting or for both receiving and transmitting. Because of the enhanced isolation between input/output ports, they are more usable for simultaneous transmission at one polarization and reception at the other polarization at the same operating frequency using the same antenna array. It should also be appreciated by those in the art that although square radiating patches have been shown in the presently preferred exemplary embodiment, there are many other known shapes of radiating patches which might be utilized.

This exemplary embodiment of the invention includes first and second microstrip radiating patches which are spaced apart and connected to first and second input/output ports by respectively corresponding first and second feedline systems. The first feedline system is connected so as to transmit/receive r.f. fields from these patches having a first primary polarization (e.g. vertical) while the second feedline system is connected with opposingly directed sides of each of the patches and having respective portions which differ in length by substantially 180 electrical degrees so as to transmit/receive r.f. fields from the pair of patches having a second primary polarization and whereby r.f. energy undesirably coupled directly between the first and second ports is substantially minimized. In this exemplary embodiment, the first and second radiating patches are each substantially square so as to resonant at substantially the same frequency along either of their orthogonal axes. This pair of patches have two respective sides that are substantially co-linear with each other while the remaining two respective sides of the pair of patches are substantially parallel to one another but displaced laterally. The first feedline system in this exemplary embodiment includes a corporate structured microstrip feedline having respective portions which lead from the first input/output port to one of the co-linear sides of the patches where the respective portions of this first feedline system are substantially equal or which at least have length differences that present substantially zero electrical degrees phase difference between r.f. signals fed to/from the radiating patches. A second feedline system connects nearest opposing ones of the parallel sides of these patches to a second input/output port with length differences between respective portions of the second feedline systems being substantially one-half wavelength or 180 electrical degrees so as to provide the desired isolation between input/output ports while simultaneously minimizing the necessary microstrip line length.

While only one specific presently preferred exemplary embodiment of this invention has been described in detail above, those ordinarily skilled in this art will readily appreciate that there are many possible modifications and variations of this exemplary embodiment which may be made without substantially departing from the novel and advantageous features of the invention as described above. Accordingly, all of these modifications and variations are intended to be included within the scope of the appended claims.

What is claimed is:

1. A dual polarized single operating frequency microstrip antenna of the type having integral microstrip feedline and resonant radiating patches in an electrically conducting layer spaced by dielectric less than one-fourth wavelength above an underlying ground plane, said antenna comprising:

a pair of spaced apart radiating patches having substantially equal resonant dimensions of approximately one-half wavelength at the intended single operating frequency and defining a common space therebetween;

a first feedline system connected to each of said pair of radiating patches outside said common space for transmitting/receiving r.f. signals to/from a first feedpoint having a first polarization at said single operating frequency; and a second feedline system connected back-to-back to each of said pair of radiating patches in the space therebetween for transmitting/receiving r.f. signals to/from a second feed point having a secodd polarization at said single operating frequency, said second polarization being different from said first polarization.

2. A dual polarized microstrip antenna of the type having integral microstrip feedline and resonant radiating patches of in an electrically conducting layer spaced by dielectric above an underlying groundplane, said antenna comprising:

a first radiating patch, a second radiating patch spaced apart from said first patch;

a first feedline system connecting a first input/output port with each of said patches so as to transmit/-receive r.f. fields therefrom having a first primary polarization, and a second feedline system connecting a second input-/output port with opposingly directed sides of each of said patches, respective portions of said second feedline system interconnecting said second port with said first and second patches differing by substantially 180 electrical degrees so as to transmit/-receive r.f. fields from the pair of patches having a second primary polarization and whereby r.f. energy undesirably coupled directly between said first and second ports is reduced.

3. A dual polarized microstrip antenna as in claim 2 wherein:

said first and second radiating patches are each of substantially square dimensions and resonant at substantially the same frequency along either of their orthogonal axes and having two respective corresponding sides of each of the patches substantially co-linear with each other while the remaining four respective sides are substantially parallel to one another but displaced from each other laterally;

said first feedline system includes a corporate structured microstrip feedline having respective portions leading from said first port to said colinear sides of said first and second patches, the length difference between said respective portions representing substantially zero electrical degrees; and said second feedline system includes a second corporate structured microstrip feedline having respective portions leading from said second port to the nearest opposing ones of said parallel sides of said first and second patches, the length difference between said respective portions representing substantially 180 electrical degrees.

4. A dual polarized microstrip antenna as in claim 2 or 3 wherein the center of said first and second radiating patches are spaced apart by approximately 0.95 wavelength at the expected antenna operating frequency.

5. An antenna array comprising plural dual polarized microstrip antennas as claimed in claim 2 or 3.

6. A dual polarized microstrip antenna comprising:

a pair of half-wavelength resonant electrically conductive patches spaced less than one-fourth wavelength above a conductive surface, each of said patches being resonant along first and second dimensions and spaced from one another by less than one wavelength;

a first feedline system having respective equal length portions connecting a first input/output port with each of said patches along said first resonant dimension; and a second feedline system having respective unequal length portions disposed between said patches and connecting a second input/output port with the oppositely directed adjacent edges of said patches along said second resonant dimension.

7. A dual polarized microstrip antenna as in claim 6 wherein:

said first and second radiating patches are each of substantially square dimensions and resonant at substantially the same frequency along either of their orthogonal axes and having two respective corresponding sides of each of the patches substantially co-linear with each other while the remaining four respective sides are substantially parallel to one another but displaced from each other laterally;

said first feedline system includes a corporate structured microstrip feedline having respective portions leading from said first port to said colinear sides of said first and second patches, the length difference between said respective portions representing substantially zero electrical degrees; and said second feedline system includes a second corporate structured microstrip feedline having respective portions leading from said second port to the nearest opposing ones of said parallel sides of said first and second patches, the length difference between said respective portions representing substantially 180 electrical degrees.

8. A dual polarized microstrip antenna as in claim 6 or 7 wherein the centers of said first and second radiating patches are spaced apart by approximately 0.95 wavelength at the expected antenna operating frequency.

9. An antenna array comprising plural dual polarized microstrip antennas as claimed in claim 6 or 7.

10. An antenna as in claim 7 wherein each of said feedline systems is connected substantially at a midpoint of respective sides of the square patches.

11. A dual polarized microstrip antenna comprising:

a pair of spaced apart resonant conductive patches having substantially equal resonant dimensions of approximately one-half wavelength at an intended single operating frequency and defining first and second sets of radiating apertures for transmitting/receiving respective differently polarized first and second r.f. fields;

a first microstrip feedline system having respective equal length portions to/from a first feedpoint connected to said pair of patches for communicating with said first set of radiating apertures; and a second microstrip feedline system disposed at least in part between said patches and having respective unequal length portions to/from a second feedpoint connected to said pair of patches for communicating with said second set of radiating apertures.

12. An antenna array comprising plural dual polarized microstrip antennas as claimed in claim 11.

13. A dual polarized microstrip antenna comprising:

a pair of spaced apart resonant conductive patches defining first and second sets of radiating apertures for transmitting/receiving respectively polarized r.f. fields;

a first microstrip feedline system having respective equal length portions to/from a first input/output port and connected to said pair of patches for communicating with said first set of radiating apertures;

a second microstrip feedline system disposed at least in part between said patches and having respective unequal length portions to/from a second input/output port and connected to said pair of patches for communicating with said second set of radiating apertures;

said first and second radiating patches each being of substantially square dimensions so as to resonate at substantially the same frequency along either of their orthogonal axes and having two respective corresponding sides of each of the patches substantially co-linear with each other while the remaining four respective sides are substantially parallel to one another but displaced laterally;

said first feedline system including a corporate structured microstrip feedline having respective portions leading from said first input/output port to said collinear sides of said first and second patches, the length difference between said respective portions representing substantially zero electrical degrees; and said second feedline system including a second corporate structured microstrip feedline having respective portions leading from said second input/output port to the nearest opposing ones of said parallel sides of said first and second patches, the length difference between said respective portions of the second feedline system representing substantially 180 electrical degrees.

14. A dual polarized microstrip antenna as in claim 13 wherein the centers of said first and second radiating patches are spaced apart by approximately 0.95 wavelength at the expected antenna operating frequency.

15. An antenna array comprising plural dual polarized microstrip antennas as claimed in claim 13.

16. An antenna as in claim 13 wherein each of said feedline systems is connected substantially at a midpoint of respective sides of the square portions.

17. A dual polarized microstrip antenna comprising:

a pair of spaced apart resonant conductive patches spaced above a reference conductive surface by a dielectric layer, the edges of said pair of patches defining four horizontal radiating apertures and four vertical radiating apertures;

said four horizontal radiating apertures including a parallel pair of substantially co-linear apertures;

said four vertical radiating apertures being parallel to one another and orthogonal to said horizontal radiating apertures;

a first feedline system of substantially equal length lines connected between a first input/output port and each of one of said pair of co-linear apertures; and a second feedline system of substantially unequal length lines disposed at least partly within the space between two of said vertical radiating apertures and connected between a second input/output port and said two of said vertical radiating apertures.

18. A dual polarized microstrip antenna as in claim 17 wherein:

said first and second radiating patches are each of substantially square dimensions so as to resonate at substantially the same frequency along either of their orthogonal axes and having two respective corresponding sides of each of the patches substantially co-linear with each other while the remaining four respective sides are substantially parallel to one another but displaced from each other laterally;

said first feedline system includes a corporate structured microstrip feedline having respective portions leading from said first port to said colinear sides of said first and second patches, the length difference between said respective portions representing substantially zero electrical degrees; and said second feedline system includes a second corporate structured microstrip feedline having respective portions leading from said second port to the nearest opposing ones of said parallel sides of said first and second patches, the length difference between said respective portions representing substantially 180 electrical degrees.

19. A dual polarized microstrip antenna as in claim 17 or 18 wherein the centers of said first and second radiating patches are spaced apart by approximately 0.95 wavelength at the expected antenna operating frequency.

20. A dual microstrip antenna as in claim 18 wherein each of said feedline systems is connected substantially at a midpoint of the respective connected aperture.

21. An antenna array comprising plural dual polarized microstrip antennas as claimed in claim 17 or 20.

22. A dual polarized microstrip antenna comprising:

a pair of spaced apart resonant conductive patches defining first and second sets of radiating apertures for transmitting/receiving respectively polarized r.f. fields;

a first microstrip feedline system having respective equal length portions connected to said pair of patches for communicating with said first set of radiating apertures; and a second microstrip feedline system disposed at least in part between said patches and having respective unequal length portions connected to said pair of patches for communicating with said second set of radiating apertures;

the centers of said first and second radiating patches being spaced apart by approximately 0.95 wavelength at the expected antenna operating frequency.

* * * * *